US008668170B2

(12) United States Patent
Lostun et al.

(10) Patent No.: US 8,668,170 B2
(45) Date of Patent: Mar. 11, 2014

(54) RAILWAY SIGNALING SYSTEM WITH REDUNDANT CONTROLLERS

(75) Inventors: Virgil Lostun, Thornhill (CA); Abe Kanner, Mississauga (CA); Sergio Mammoliti, Kitchener (CA); Cameron Fraser, Maple (CA)

(73) Assignee: Thales Canada Inc., Toronto, Ontario (CA)

( * ) Notice: Subject to any disclaimer, the term of this patent is extended or adjusted under 35 U.S.C. 154(b) by 236 days.

(21) Appl. No.: 13/169,160

(22) Filed: Jun. 27, 2011

(65) Prior Publication Data

US 2012/0325981 A1 Dec. 27, 2012

(51) Int. Cl.
*B61L 5/00* (2006.01)

(52) U.S. Cl.
USPC ..... 246/219; 701/19

(58) Field of Classification Search
USPC ..... 246/218, 219, 28 R, 31, 32, 34 R
See application file for complete search history.

(56) References Cited

U.S. PATENT DOCUMENTS

| | | | | |
|---|---|---|---|---|
| 7,140,577 | B2 * | 11/2006 | Mollet et al. | 246/218 |
| 7,577,502 | B1 * | 8/2009 | Henry et al. | 701/19 |
| 2002/0173884 | A1 * | 11/2002 | Clawson | 701/19 |
| 2004/0010432 | A1 * | 1/2004 | Matheson et al. | 705/7 |
| 2006/0059202 | A1 * | 3/2006 | Niimura | 707/104.1 |
| 2006/0259202 | A1 * | 11/2006 | Vaish | 700/295 |
| 2007/0162199 | A1 * | 7/2007 | Katsuta et al. | 701/19 |
| 2007/0228223 | A1 * | 10/2007 | Dittmar et al. | 246/28 R |
| 2008/0183306 | A1 * | 7/2008 | Ashraf et al. | 700/4 |
| 2009/0143928 | A1 * | 6/2009 | Ghaly | 701/19 |
| 2011/0006167 | A1 * | 1/2011 | Tolmei | 246/121 |
| 2011/0276285 | A1 * | 11/2011 | Alexander et al. | 702/58 |
| 2012/0138752 | A1 * | 6/2012 | Carlson et al. | 246/126 |

FOREIGN PATENT DOCUMENTS

| | | | |
|---|---|---|---|
| EP | 0472747 | A1 | 3/1992 |
| JP | 2000159108 | A2 | 6/2000 |
| JP | 2004175186 | A2 | 6/2004 |
| WO | 2008080169 | A1 | 7/2008 |

OTHER PUBLICATIONS

Matthew John Morley, "Safety Assurance in Interlocking Design", 1996.

(Continued)

*Primary Examiner* — Jason C Smith
(74) *Attorney, Agent, or Firm* — Marks & Clerk; Hetal Kushwaha

(57) ABSTRACT

Disclosed is a railway signaling system for controlling a load. In accordance with the teachings of this invention, the system comprises a first autonomous controller and a second autonomous controller which is redundant with the first controller, each controller connectable to the load such that there is no single point of failure. The first and second controllers operable in either an on-line mode wherein both power outputs provide power to the load or an off-line mode wherein a single power output does not provide power to the load. On-line controllers monitor current therethrough. When both controllers are on-line, the current between the two controller is imbalanced up to a threshold limit, if the threshold limit is exceeded by one controller, that controller will go off line, and if the first controller is off-line and the second controller is on-line, the second controller monitors output voltages of the off-line controller to ascertain that the output voltages are zero.

14 Claims, 7 Drawing Sheets

(56) References Cited

OTHER PUBLICATIONS

Anees A. Shaikh, "Design of Input and Output Modules for a Safety-Critical Wayside Train Control System", Aug. 1994.

"RTD Design Guidelines & Criteria Commuter Rail Design Criteria", Section 8—Signal System, Apr. 2009.

Ramon Abelleyro, "Positive Train Control", Mar. 2009.

"Do You Know Where Your Train Is?", The Availability Digest, Oct. 2006.

"WESTLOCK and WESTRACE: Advanced, Flexible, Powerful and Retro-Compatible", Inter Lock System, http://www.invensysrail.com.

"Flexible Vital Interlocking", WESTRACE (VLM6), http://www.invensysrail.com.

"AF-902/AF-904® Generation II Digital FSK Track Circuit", Ansaldo STS USA, www.ansaldo-sts.com.

* cited by examiner

ACTIVE-ACTIVE LOAD TYPE-A CONFIGURATION

ACTIVE-ACTIVE LOAD TYPE-B (COMMON RETURN) CONFIGURATION

RAILWAY SIGNALING SYSTEM WITH REDUNDANT CONTROLLERS

FIELD OF THE INVENTION

The present invention relates to the rail industry. More specifically, the present invention relates to railway signaling systems.

BACKGROUND OF THE INVENTION

The rail industry, for both passenger and freight trains, is an important industry worldwide. Obviously the safety and reliability of train systems is crucial. Rail systems are particularly vulnerable to catastrophic accidents since trains travel on fixed tracks at speeds that prevent them from being able to stop quickly.

Railway signaling systems are used to communicate a multitude of information to various railway personnel. Various types of trackside equipment (point/switch machine, signals, track circuits) are used along the track line. Trackside equipment can communicate different types of information, such as track status, required speeds, etc., all being crucial to preventing trains from colliding.

The consequence of failure of trackside equipment can be disastrous. As such, current systems employ safety methods to mitigate failure or error. Regular maintenance of trackside equipment must also be taken into account.

Generally, trackside equipment is managed by devices such as interlockings and zone controllers. Typically these controllers manage trackside field equipment through vital relay groups, in some cases, custom direct drive boards have been developed to interface with particular equipment types.

Existing known solutions which manage dual outputs (redundant configuration for zone controllers) are controlled through an external hardware "OR" device, which is a single point of failure. Additionally, these design solutions are configured only as active-passive and thus manage a controlled switchover which interrupts the final condition.

SUMMARY OF THE INVENTION

Currently there is no redundant configuration solid state direct driver solution in the art of railway signaling systems which is free of a single point of failure to provide an active-active configuration for outputs connected to a common load. Embodiments of the present invention provide a safe solution for active-active redundant system which eliminates the switching time required by the active-passive system during the controlled switchover. Therefore there will be no interruption in the control and monitoring of the trackside equipment, eliminating the transitory periods (signals flashing or interlocking relays being wrongfully de-energized)

Embodiments of the present invention also provide means of safe testing of one redundant system without affecting the safe functionality of the other system.

Accordingly, disclosed is a railway signaling system comprised of a dedicated control circuit in an entirely redundant configuration (and thus with no single point of failure). Embodiments of the invention power dual outputs seamlessly, providing a continuous and unflinching electrical supply to a load to counteract output disruption during both scheduled maintenance and fail-over.

The load in accordance with the teachings of this invention is any suitable trackside equipment (for example: signals) or interlocking relay used in railway signaling systems.

Embodiments of the invention contemplate providing a redundant design, entirely free of single point of failures, such that a failure or planned maintenance activity in one resident partner of the system can be achieved without affecting system operations. In addition, the actual outputs are driven simultaneously between each hardware partner commanding a common load, reacting to failover/switchover without perturbation to outputs resulting in seamless redundancy.

In accordance with the teachings of this invention, full system hardware redundancy is supported by using two independent controllers which command a load in active-active (where both controllers are on-line) configuration. With each controller active and healthy, the current through the load is shared between each system.

It is envisaged that when one of the autonomous units detects a failure in functionality, that failed controller is disconnected and isolated from the working system while the live redundant controller continues to command the load seamlessly.

Since embodiments of the invention are envisaged for use in railway signaling systems, various safety critical features are provided. These include continuous output current monitoring, voltage threshold detection, management of outputs, and means of load current supervision of dual "active-active" outputs at higher processing level.

Thus, according to one aspect, the invention provides a railway signaling system for controlling a load, the system comprising a first autonomous controller with a first power output connectable to the load; a second autonomous controller which is redundant with the first controller such that there is no single point of failure, the second controller having a second power output connectable to the load; the first and second controllers operable in either an on-line mode wherein both power outputs provide power to the load or an off-line mode wherein a single power output does not, provide power to the load; wherein the first and second controllers normally operate in the on-line mode to control the load such that current through the load is shared between the first and second controllers; wherein if one of the first or second controllers is operating off-line, the other controller continues to operate on-line to control the load, whereby control of the load is uninterrupted.

Thus, according to one aspect, the invention provides a method of controlling a load in a railway signaling system, the method comprising providing a first autonomous controller connectable to the load and a second autonomous controller which is redundant with the first controller such that there is no single point of failure; operating the first and second controllers in either: an on-line mode wherein both controllers provide power to the load to control the load such that current through the load is shared between the first and second controllers; or in an off-line mode wherein a single controller does not provide power to the load and the other controller continues to operate on-line to control the load, whereby control of the load is uninterrupted.

Thus, according to one aspect, the invention provides a railway signaling system for controlling a load, the system comprising a first autonomous controller and a second autonomous controller which is redundant with the first controller, each controller connectable to the load such that there is no single point of failure; the first and second controllers operable in either an on-line mode wherein both power outputs provide power to the load or an off-line mode wherein a single power output does not provide power to the load.

Embodiments of this invention are designed based on CENEC EN-50129 and AREMA Part 16 and 17 standards and industry standard principles.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE DISCLOSED EMBODIMENTS

Figure 1:
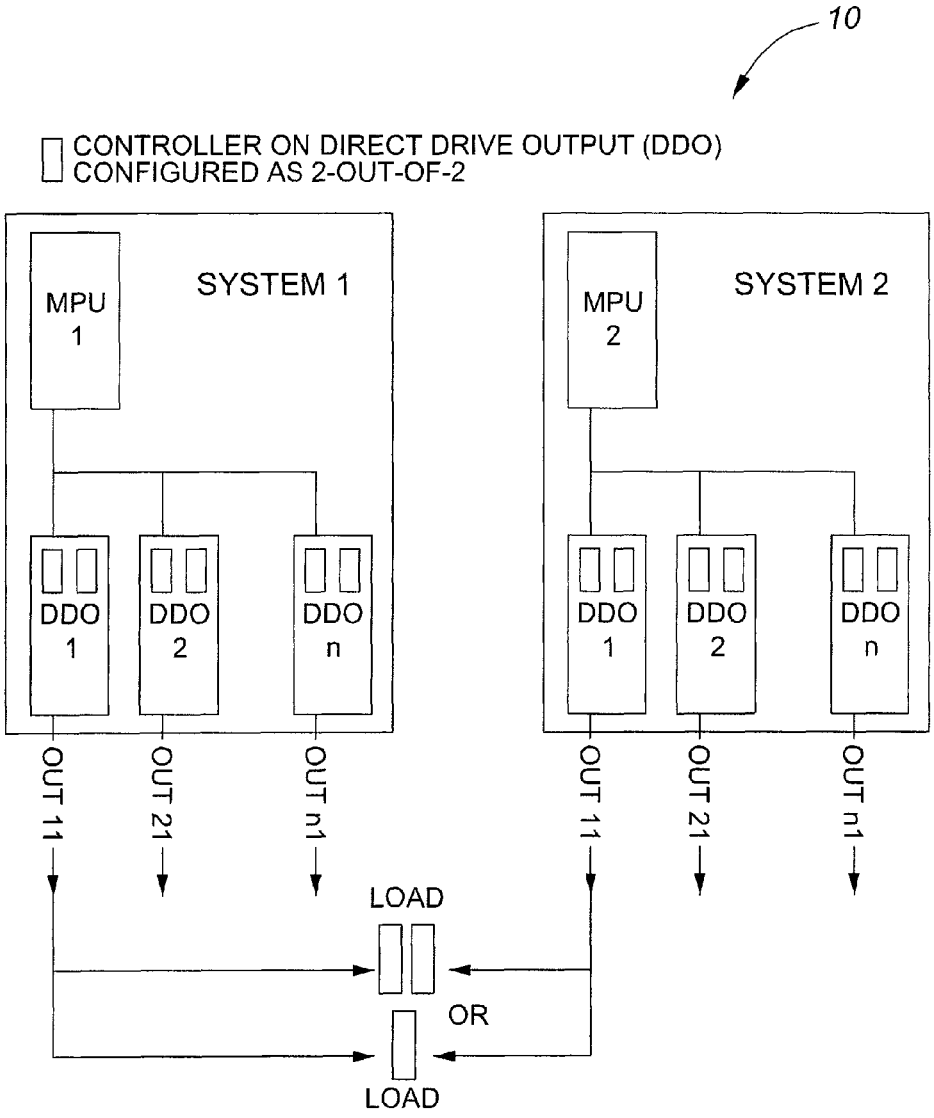
FIG. 1 illustrates a top level schematic of a railway signaling system in accordance with the teachings of this invention.

Referring to FIG. 1, there is illustrated a top level schematic drawing of a railway signaling system in accordance with the teachings of this invention. The complete system 10 comprises System 1 and System 2 having a first and a second controller, MPU1 and MPU2. Each controller, MPU1 and MPU2, has multiple direct drive outputs (designated as DDO 1 . . . n), a power bus and output, OUTn, in communication with the load(s). Each controller MPU1 and MPU2 is independent of the other and is completely redundant. In this way, the system 10 is free of any single point of failure. Further details will be discussed below.

Figure 4:
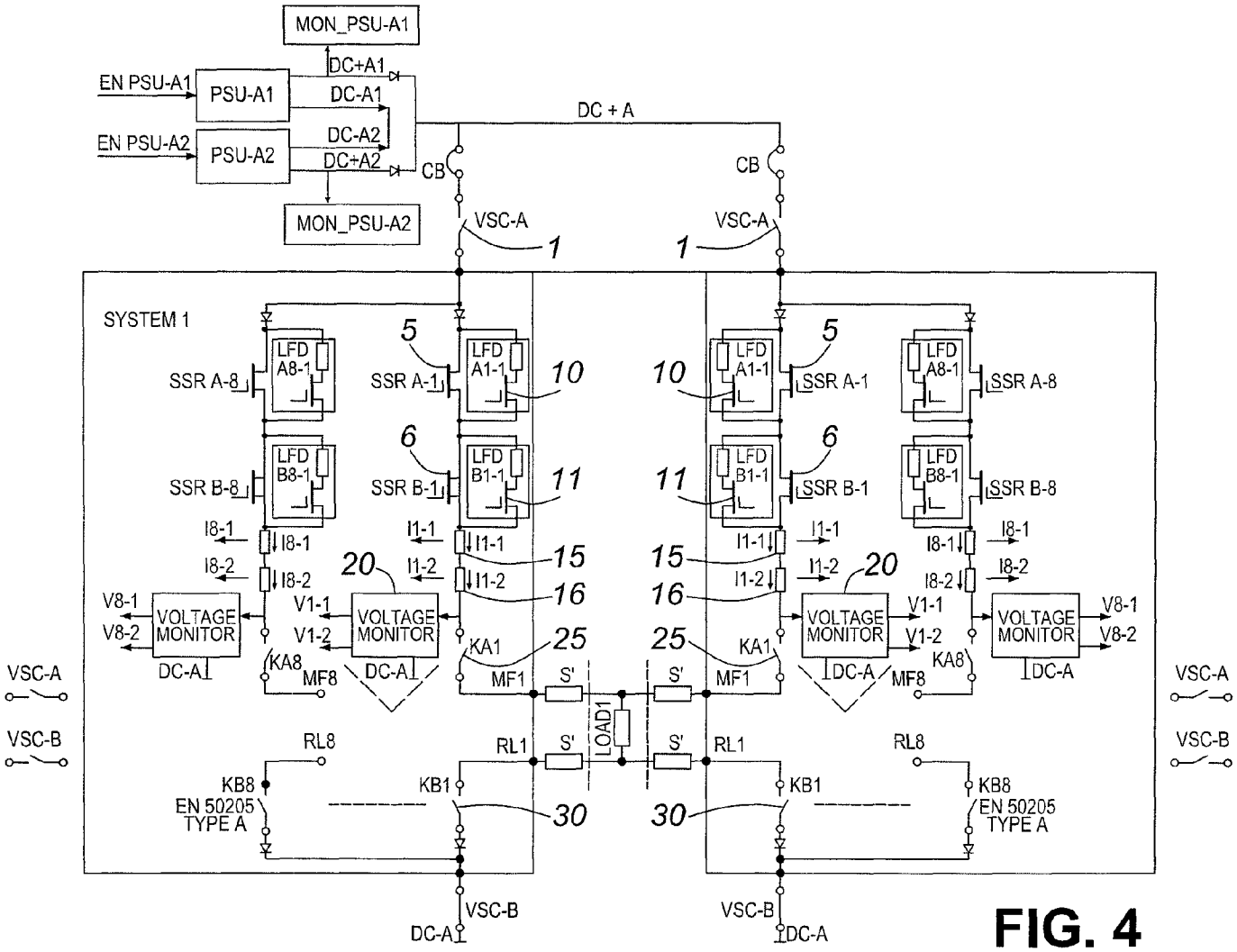
FIG. 4 illustrates a detailed configuration of the direct drive output with generic common load output circuit, wherein both controllers are active.

Both controllers MPU1 and MPU2 use the same power supply, though each is protected by individual circuit breakers. This common power supply can be either AC or DC source. The DC power source for the outputs is represented in FIG. 4 (PSU-A1, PSU-A2) The AC power source for the outputs is presented in FIG. 5 (TB, TC)

Referring back to FIG. 1, each controller, MPU1 and MPU2, is operable in either an on-line mode or an off-line mode. On-line mode means the controller is "on" to control the load(s); off-line means the controller is "off" and is not controlling the load(s). Within the system 10, both controllers MPU1 and MPU2 can be on-line or one controller can be on-line with one controller being off-line. A controller can be off-line either due to a failure in operation or due to a planned maintenance.

The load (there could be more than one) in accordance with the teachings of this invention is any suitable physical signal used in railway signaling systems. For example, the load could be a light system to communicate various information to a train conductor.

The system is designed to react in specific actions based on the operation of the controllers.

If both controllers on on-line, the both controllers provide power via respective outputs, DDO, to the load. In such an active-active mode (where both controllers are on-line), the current through the load is shared by the two controllers. The imbalance of current sharing between the two redundant systems is allowed up to a threshold limit. If the threshold limit is exceeded by one system, that system will declare a failure and isolate from the load, thus the redundant system will control solely the load. Each DDO is composed out of two microcontrollers (uC) in a 2oo2 configuration (uC-A and uC-B), and the specific functional circuits to provide the interface to external elements.

Referring back to FIG. 4, it can be seen that each microcontroller has a respective current monitoring circuit 15, 16. In an active-active mode, each current monitoring mechanism monitors the current that the controller is providing to the load.

In order to correctly determine the load status, each controller (MPU 1 and MPU2) monitors if the load is shared or not (information available based on communication path between the two systems) and also the configuration of the load. It should be noted that there could be multiple loads connected in parallel, controlled with a single output from each controller as illustrated in FIG. 1. This information is part of the system database available at the MPU1 and MPU2 level. The output of each current monitoring circuit is proportional with the current through the outputs and the load. Statuses are independently provided to each uC for each output.

The current is monitored continuously. In order to validate the current measurement, there are two threshold references: for minimum load (preferably: 10% of nominal current) and nominal load (preferably: 75% of nominal current). The two threshold references are common for both controllers. These references are used to characterize the A/D conversion parameters for each controller.

In case of threshold failure (based on exceeding the tolerance of reference readings from each controller) the system will declare a failure and it will isolate itself from the load.

Each DDO also has a disconnection mechanism 25, 30 (isolation from load). The disconnection mechanism (illustrated in FIG. 4 as relay contacts KD-A1 (25) to KD-A8 and relay contacts KD-B1 (30) to KD-B8) is used to disconnect an off-line controller's output from the load. To correctly identify the status of disconnection mechanism, the relays conform with EN50205 typeA requirements. Preferably, when an independent unit fails or goes off-line, disconnection of its outputs is also guaranteed by means of an external hardware shutdown 1 which is AREMA Class 1 compliant. The hardware shutdown mechanism can be any suitable mechanism. Preferably this vital disconnect is implemented through Association of American Railway (AAR) vital relays.

Embodiments of the invention ensure that when one of the autonomous controllers MPU1 and MPU2 fail or goes off-line, the remaining on-line controller continuously monitors that no failure of the off-line controller will compromise safe system operations. In particular, it can be seen from FIG. 4 that each output further comprises a voltage monitoring circuit 20. The controller shut off and/or off-line status, will prompt the following additional supervisions by the remaining on-line unit. The output voltage of every individual output of on-line controllers is monitored to ascertain that the voltage is zero when the individual output is commanded off.

Figure 2:
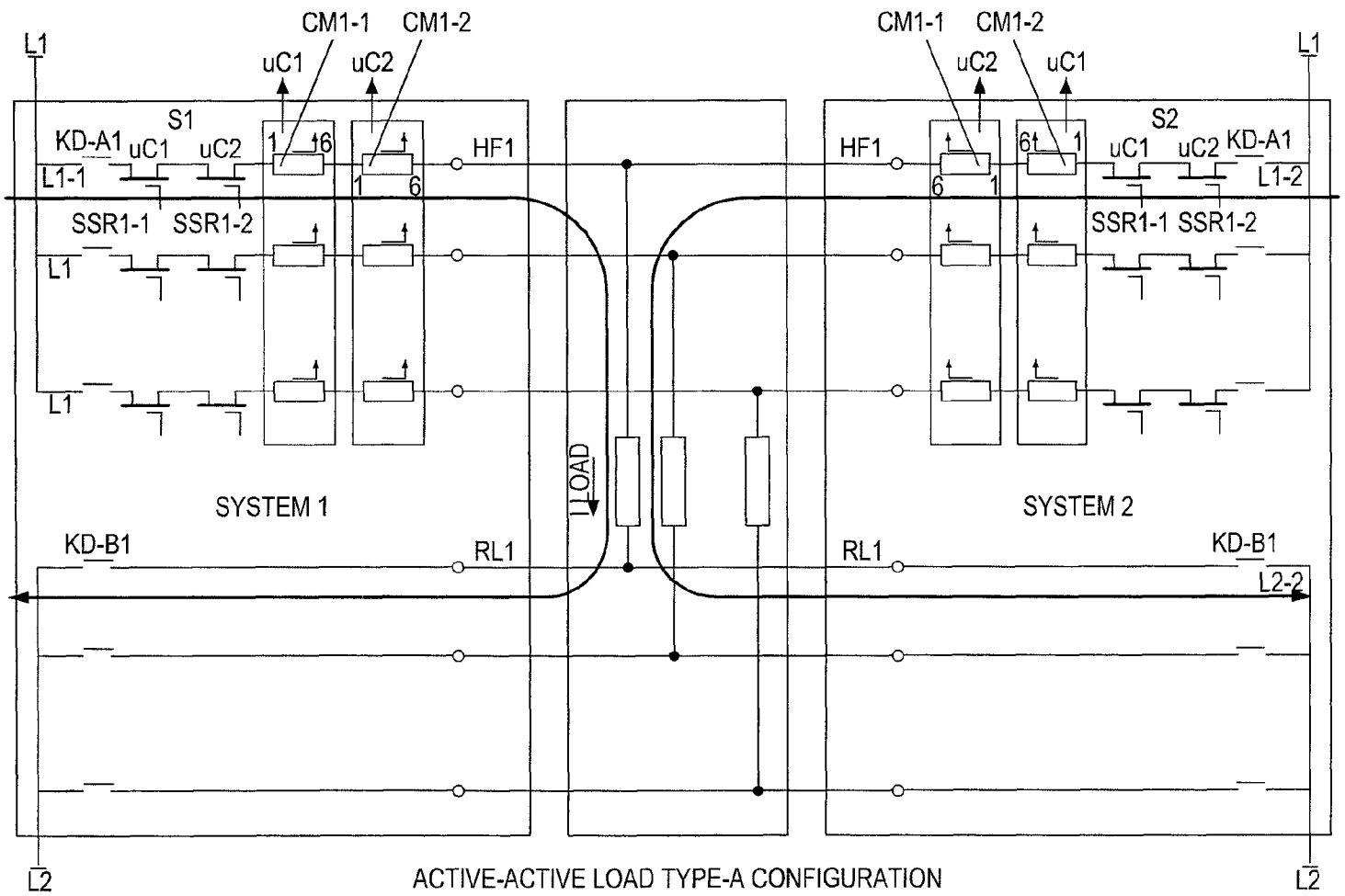
FIG. 2 illustrates circuitry of a railway signaling system in accordance with the teachings of this invention wherein both controllers are active output controls commanding the load simultaneously (load being controlled in double-cut configuration when both supply and return lines are controlled by the redundant system)

FIG. 2 illustrates circuitry of a railway signaling system in accordance with the teachings of this invention wherein both controllers (system 1 and system 2) are active output controls commanding the load simultaneously. The example illustrated is a double-cut load (individual return) control configuration.

System 1 controls the load from the supply line (L1) through the disconnection relay (S1-KD-A1) a solid state relay (S1-SSR1-1) under S1-DDO-uC1 control, a solid state relay (S1-SSR1-2) under S1-DDO-uC2 control, current measuring for S1-DDO-uC1 (S1-CM1-1), current measuring for S1-DDO-uC2 (S1-CM1-2), load, disconnection relay (S1-KD-B1) to return line (L2).

Supply line (L1) and return line (L2) can be either AC or DC supply.

System 2 controls the load from the supply line (L1) through the disconnection relay (S2-KD-A1) a solid state relay (S2-SSR1-1) under S2-DDO-uC1 control, a solid state relay (S2-SSR1-2) under S2-DDO-uC2 control, current measuring for S2-DDO-uC1 (S2-CM1-1), current measuring for S2-DDO-uC2 (S2-CM1-2), load, disconnection relay (S2-KD-B1) to return line (L2). Under normal conditions the current through load is equally shared between the two systems.

Figure 3:
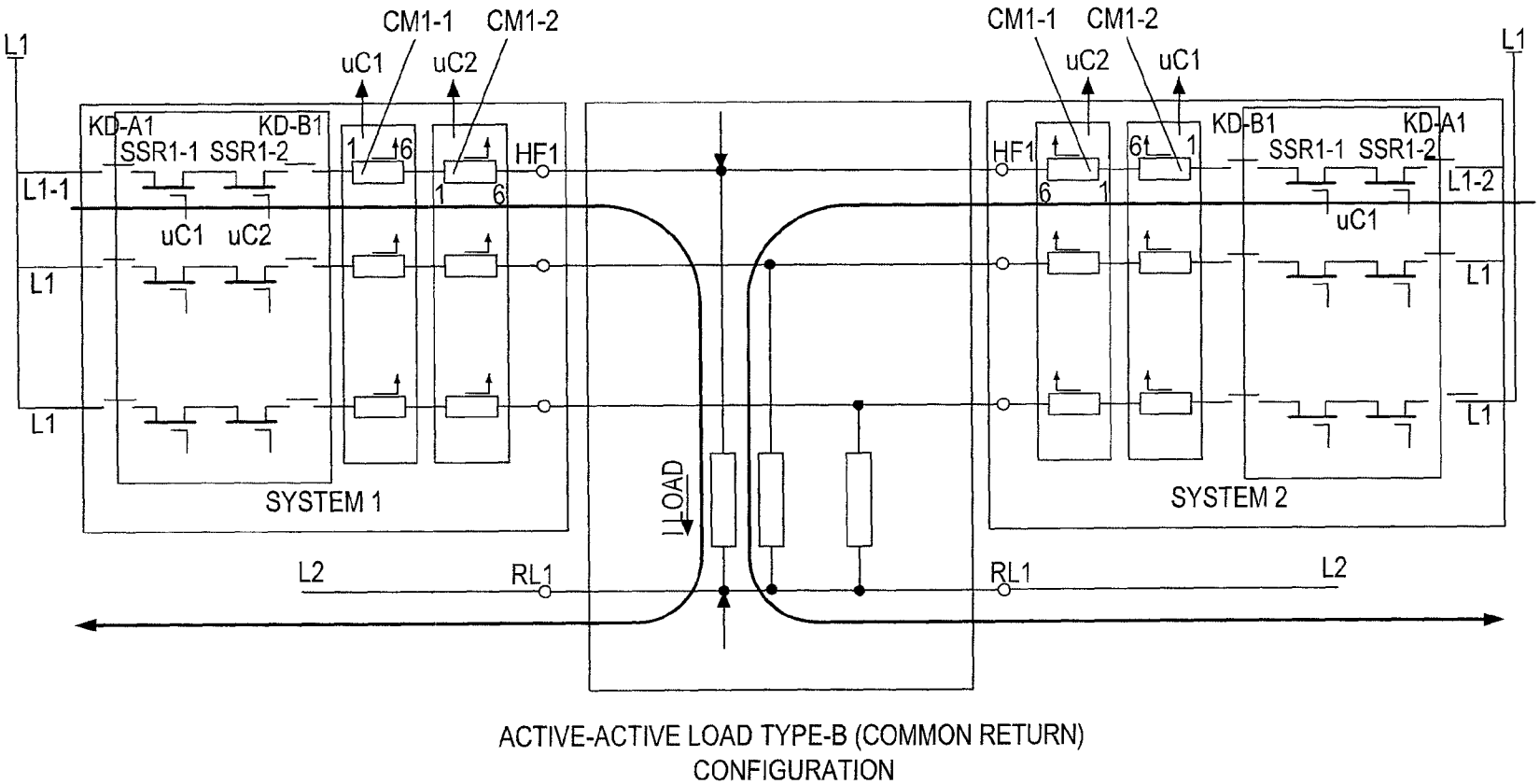
FIG. 3 illustrates a railway signaling system in accordance with the teachings of this invention wherein both controllers are active output controls commanding the load simultaneously (load being controlled in common return configuration when only supply line is controlled by the redundant system)

FIG. 3 illustrates a railway signaling sys accordance with the teachings of this invention wherein both controllers are active output controls commanding the load simultaneously. The example illustrated is a double-cut load (common return) control configuration.

System 1 controls the load from the supply line (L1) through the disconnection relay (S1-KD-A1) a solid state relay (S1-SSR1-1) under S1-DDO-uC1 control, a solid state relay (S1-SSR1-2) under S1-DDO-uC2 control, disconnection relay (S1-KD-B1), current measuring for S1-DDO-uC1 (S1-CM1-1), current measuring for S1-DDO-uC2 (S1-CM1-2) load, to return line (L2).

Supply line (L1) and return line (L2) can be either AC or DC supply.

System 2 controls the load from the supply line (L1) through the disconnection relay (S2-KD-A1) a solid state relay (S2-SSR1-1) under S2-DDO-uC1 control, a solid state relay (S2-SSR1-2) under S2-DDO-uC2 control, disconnection relay (S2-KD-B1), current measuring for S2-DDO-uC1 (S2-CM1-1), current measuring for S2-DDO-uC2 (S2-CM1-2), load, to return line (L2).

Under normal conditions the current through load is equally shared between the two systems.

FIG. 4 illustrates a generic common load output circuit wherein both controllers are active. This generic output circuit is implemented as a series double cut configuration with Solid State Relay 5, 6 (SSR) control and a double cut configuration for circuit isolation 25, 30 (KD relays are FAR type).

Embodiments of the invention also contemplate latent failure detection test of reactive solid state hardware components. Referring to FIG. 4, individual outputs contain SSR with Latent Failure Detection circuitry 10, 11 (one each controlled by each controller) for leakage on SSR circuits. The leakage detection is implemented when the SSRs 5, 6 are commanded OFF. Latent Failure Detection (LFD) test consists in activation of the LFD SSR10, 11 and series resistor (for example a LFD SSR 10 to test SSR B-1 6, and LFD SSR 11 to test SSR A-1 5) and measuring of the current 15, 16. The test is sequential, test one SSR at a time, and in case that there is no failure there will be no current detected.

A test is implemented to validate the OFF state of the load by simulating leakage on both LFD SSRs 10, 11, commanding LFD A1-1 and LFD B1-1 simultaneously. The current through the load is limited by the LFD resistors which guarantee that the current cannot increase during test. The test to validate the OFF state of the load is performed every time when the LFD test is performed.

The latent failure detection test has no effect on outputs which are commanded ON. The LFD test sequence is implemented on programmable devices (FPGAs). The start of LFD test is generated by the controllers (uCs) command to FPGAs. The output LFD timing is found in FIG. 7.

Implementation:

1. Start of LFD test is provided by one uC by for duration of tSW (OLFD_START in the drawing below),
2. The programmable devices will provide a synchronization signal (OTOV in the drawing below). The synchronization signal provides information regarding the LFD testing step, which will trigger the uC to read the current status.
3. A delay (tSL) is implemented in the FPGA in order to validate the OLFD_START signal from uC (provide a digital filtering for noise).
4. Each uC reads the status of output current sequential (OUT_STATUS_(0) to OUT_STATUS_(7))

Figure 7:
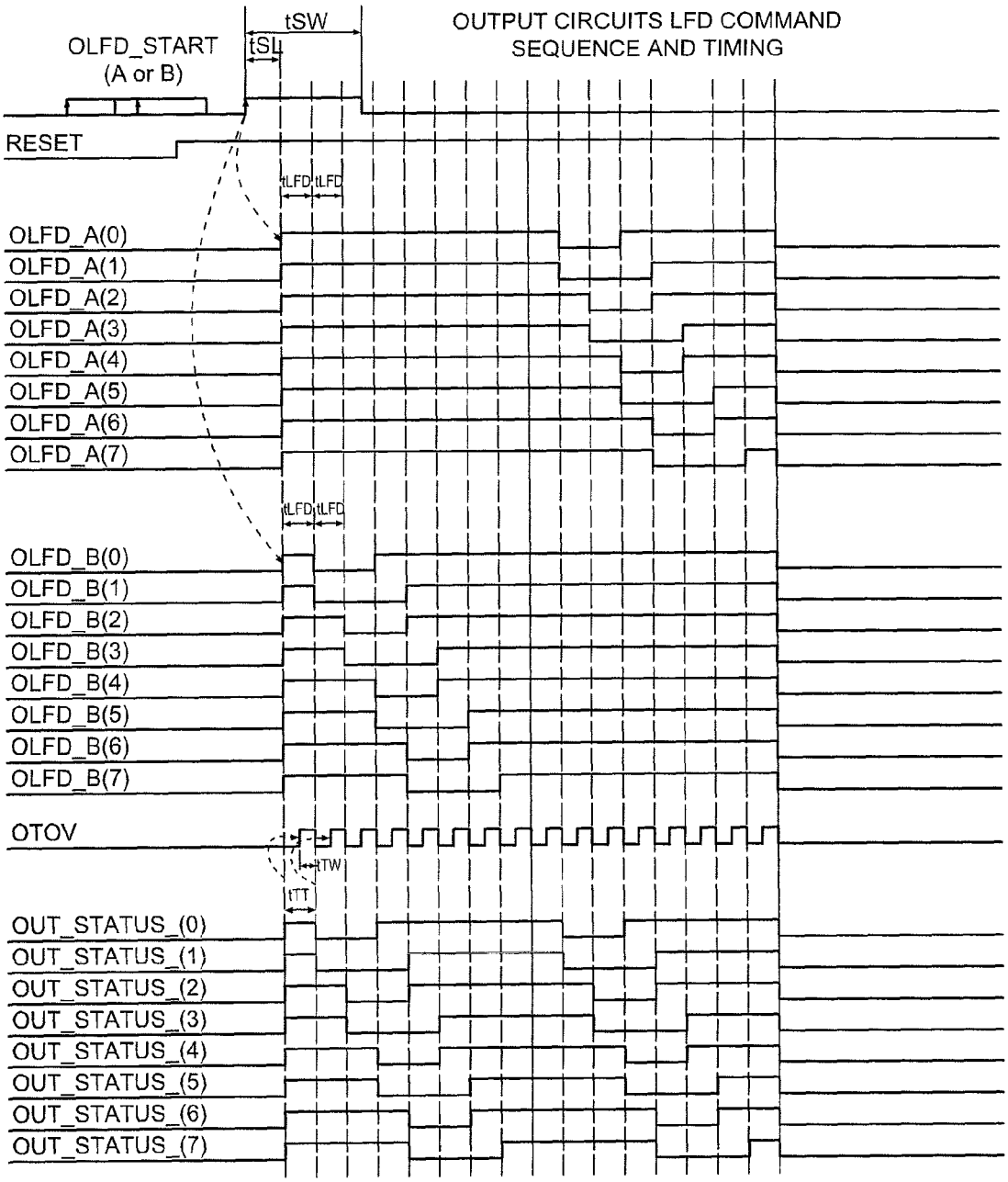
FIG. 7 illustrated the output of latent failure detection test as can be implemented in accordance with the teachings of this invention.

Referring to FIG. 7, signals OLFD_A(0) to OLFD_A(7) are generated by the FPGA1 to enable the LFD SSRs A1-1 to LFD_A8-1.

Signals OLFD_B(0) to OLFD_B(7) are generated by the FPGA2 to enable the LFD SSRs B1-1 to LFD_B8-1.

Signals OUT_STATUS_(0) to OUT_STATUS_(7) are the result at the system level of the sequential commands from both FPGAs.

Figure 5:
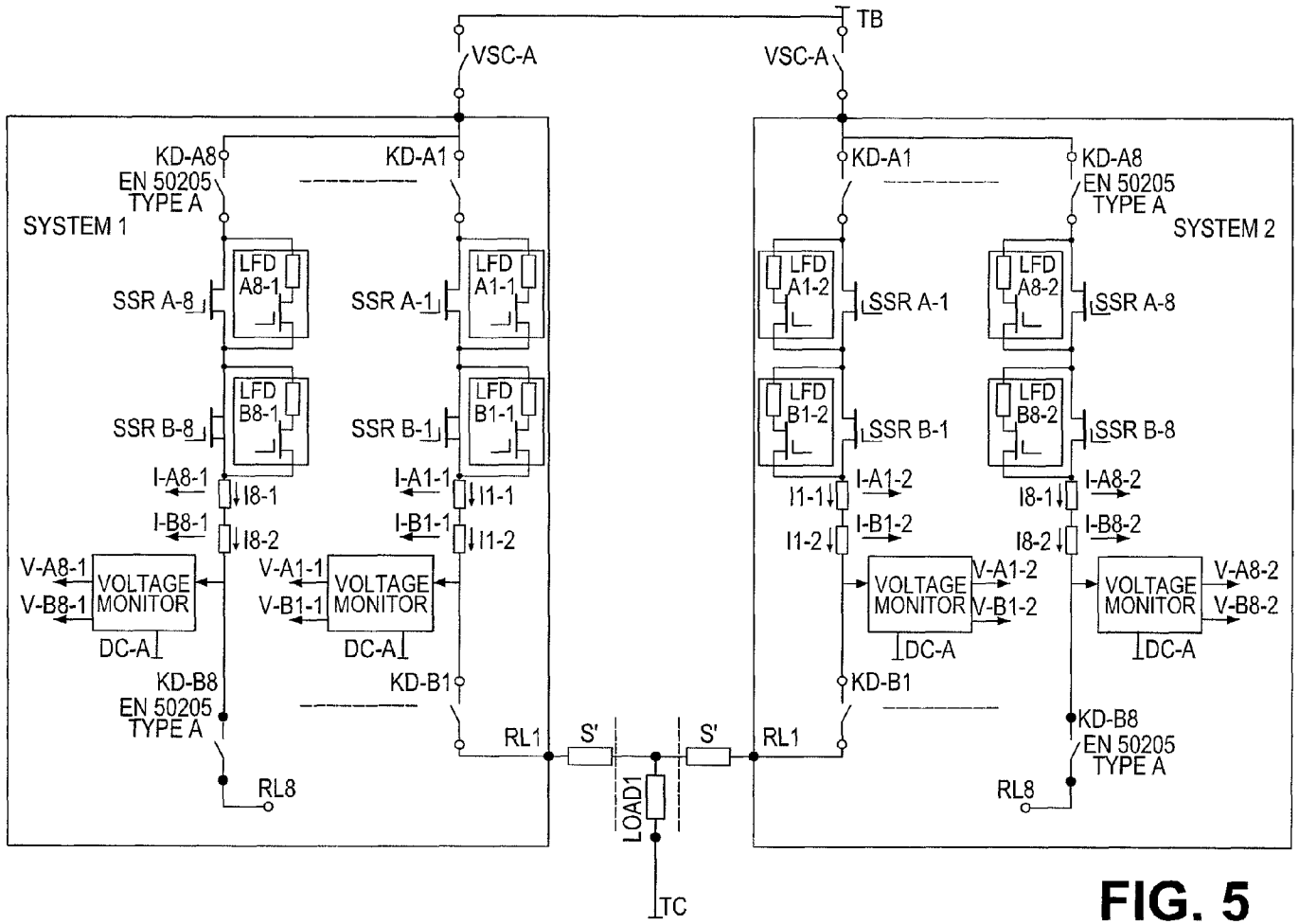
FIG. 5 illustrates another implementation option of a railway system in accordance with the teachings of this invention.

FIG. 5 illustrates another implementation option of a railway system in accordance with the teachings of this invention. In this example, both controllers are on-line and the circuit is a common return loads output circuit.

Figure 6:
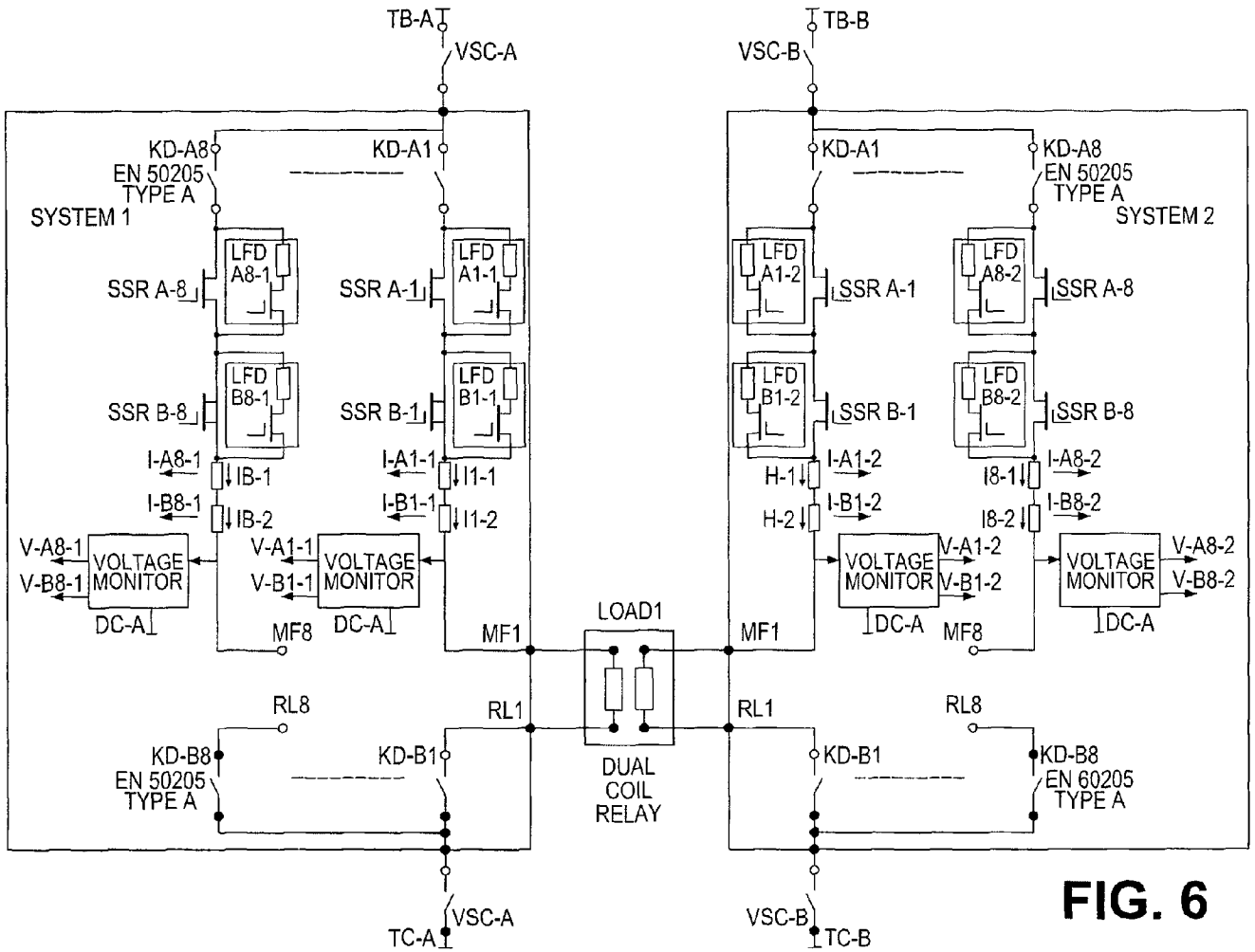
FIG. 6 illustrates another implementation option of a railway system in accordance with the teachings of this invention.

FIG. 6 illustrates another implementation option of a railway system in accordance with the teachings of this invention. In this example, both controllers are on-line and the circuit is a dual coil relay control.

It should be understood that embodiments of the invention can be installed at any suitable lineside location, such as the start of a section of track, at a junction, etc. or used in single or double tracks.

Numerous modifications may be made without departing from the spirit and scope of the invention as defined in the appended claims.

What is claimed is:

1. A railway signaling system for controlling a load, the system comprising:

first autonomous controller with a first power output connectable to the load;

a second autonomous controller which is redundant with the first controller such that there is no single point of failure, the second controller having a second power output connectable to the load;

the first and second controllers operable in either an on-line mode wherein both power outputs provide power to the load or an off-line mode wherein a single power output provide power to the load;

wherein the first and second controllers normally operate in the on-line mode to control the load such that current through the load is shared between the first and second controllers;

wherein if one of the first or second controllers is operating off-line, the other controller continues to operate on-line to control the load, whereby control of the load is uninterrupted.

2. The railway signaling system of claim 1, the first controller comprising a first current monitoring mechanism and the second controller comprising a second current monitoring mechanism, wherein;

if both the first and second controllers are on-line, the first controller current monitoring mechanism monitors the current through its respective circuit controlling the load and the second controller current monitoring mechanism monitors the current through its respective circuit controlling the load.

3. The railway signaling system of claim 1, wherein when both controllers are on-line, the current between the two controller is imbalanced up to a threshold limit.

4. The railway signaling system of claim 3, wherein if the threshold limit is exceeded by one controller, that controller will go off line.

5. The railway signaling system of claim 1, the first controller comprising a first voltage monitoring mechanism and the second controller comprising a second voltage monitoring mechanism, wherein:

if the first controller is off-line and the second controller is on-line, the second voltage monitoring mechanism monitors output voltages of the power Outputs of on-line controller to ascertain that the output voltages are zero.

6. The railway signaling system of claim 1, wherein each of the first and second controllers comprises a disconnection mechanism to disconnect its respective controller from the load in the off-line mode.

7. The railway signaling system of claim 6, wherein each disconnection mechanism comprises AAR vital relays.

8. The railway signaling system of claim 1, wherein the first and second controllers are powered by a single power source.

9. The railway signaling system of claim 8, wherein the single power source is either AC or DC.

10. The railway signaling system of claim 1, wherein the load is a. physical signal located lineside along a train track.

11. The railway signaling system of claim 1, wherein the off-line mode occurs either due to a failure or due to maintenance.

12. A railway signaling system for controlling a load, the system comprising;

a first autonomous controller and a second autonomous controller which is redundant with the first controller, each controller connectable to the load such that there is no single point of failure;

the first and second controllers operable in either an on-line mode wherein both controllers provide power to the load or an off-line mode wherein a single controller provide power to the load.

13. The railway signaling system of claim 12, wherein:

on-line controllers monitor current therethrough;

when both controllers are on-line, the current between the two controller is imbalanced up to a threshold limit; and if the threshold limit is exceeded by one controller, that controller will go off line.

14. The railway signaling system of claim 13, wherein if the first controller is off-line and the second controller is on-line, the second controller monitors output voltages of the off-line controller to ascertain that the output voltages are zero.

* * * * *